US007033192B2

(12) United States Patent
Hansen

(10) Patent No.: US 7,033,192 B2
(45) **Date of Patent: *Apr. 25, 2006**

(54) X-RAY TUBE HIGH VOLTAGE CONNECTOR

(75) Inventor: Wayne Hansen, Centerville, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/982,566

(22) Filed: Nov. 5, 2004

(65) Prior Publication Data

US 2005/0064750 A1 Mar. 24, 2005

Related U.S. Application Data

(62) Division of application No. 10/213,624, filed on Aug. 6, 2002, now Pat. No. 6,816,574.

(51) Int. Cl.
*H01R 13/53* (2006.01)

(52) U.S. Cl. ..... 439/181; 439/276; 439/936

(58) Field of Classification Search ..... 439/181, 439/276, 936

See application file for complete search history.

(56) References Cited

U.S. PATENT DOCUMENTS 3,888,559 A * 6/1975 Geib ..... 439/258
3,904,264 A * 9/1975 Oertle ..... 439/273
4,335,928 A 6/1982 Barrett et al.
4,362,348 A 12/1982 Stephenson et al.
4,494,811 A 1/1985 Palermo, Jr.
4,767,961 A 8/1988 Koller et al.
4,799,248 A 1/1989 Furbee et al.
4,806,113 A 2/1989 Rate et al.
5,145,402 A 9/1992 Plyler et al.
5,154,638 A 10/1992 Sireul et al.
5,162,267 A 11/1992 Smyth
5,310,361 A 5/1994 Muchowicz et al.
5,358,419 A 10/1994 Pejsa et al.
5,384,820 A 1/1995 Burke
5,553,114 A 9/1996 Siemers et al.
5,707,252 A 1/1998 Meszaros
6,140,582 A 10/2000 Sheehan
6,198,802 B1 3/2001 Elliot et al.
6,213,805 B1 4/2001 Jedlitschka et al.
6,556,654 B1 * 4/2003 Hansen et al. ..... 378/101
6,816,574 B1 * 11/2004 Hansen ..... 378/121

* cited by examiner

*Primary Examiner*—Tho D. Ta
(74) *Attorney, Agent, or Firm*—Workman Nydegger

(57) ABSTRACT

A high voltage connector assembly is disclosed for use with high power apparatus including x-ray devices. The present connector is a pancake-style connector, and interconnects a high voltage cable with the cathode of the x-ray tube. The present connector includes a housing, a socket assembly, and insulating material surrounding the socket assembly to insulate it from the housing. The socket assembly comprises a potting-filled conductive sleeve having a continuously shaped, smooth terminal end. The terminal end of the sleeve forms a triple junction with the insulating material and air present near the sleeve. The continuously smooth terminal sleeve end prevents electrical arcing to occur at the triple junction by reducing field strength at the terminal end and urging the electric field of the socket assembly away from the triple junction. The reduction in electrical arcing propensity allows the x-ray device to operate at relatively higher operating voltages.

20 Claims, 6 Drawing Sheets

X-RAY TUBE HIGH VOLTAGE CONNECTOR

CROSS-REFERENCE TO RELATED APPLICATIONS

This application is a divisional application, and claims the benefit of U.S. patent application Ser. No. 10/213,624, filed Aug. 6, 2002, and entitled X-RAY TUBE HIGH VOLTAGE CONNECTOR, which will issue as U.S. Pat. No. 6,816,574 on Nov. 9, 2004. That application is incorporated herein by reference in its entirety.

BACKGROUND OF THE INVENTION

1. The Field of the Invention

The present invention generally relates to x-ray generating devices. In particular, the present invention relates to a high voltage connector that reduces the likelihood of electrical arcing during operation of the x-ray device.

2. The Related Technology

X-ray generating devices are extremely valuable tools that are used in a wide variety of applications, both industrial and medical. For example, such equipment is commonly employed in areas such as medical diagnostic examination and therapeutic radiology, semiconductor manufacture and fabrication, and materials analysis.

Regardless of the applications in which they are employed, x-ray devices operate in similar fashion. In general, x-rays are produced when electrons are emitted, accelerated, and then impinged upon a material of a particular composition. This process typically takes place within an evacuated enclosure of an x-ray tube. Disposed within the evacuated enclosure is a cathode, or electron source, and an anode oriented to receive electrons emitted by the cathode. The anode can be stationary within the tube, or can be in the form of a rotating annular disk that is mounted to a rotor shaft that, in turn, is rotatably supported by a bearing assembly. The evacuated enclosure is typically contained within an outer housing, which also serves as a coolant reservoir.

In operation, an electric current is supplied to a filament portion of the cathode, which causes a cloud of electrons to be emitted via a process known as thermionic emission. A high voltage potential is placed between the cathode and anode to cause the cloud of electrons to form a stream and accelerate toward a focal spot disposed on a target surface of the anode. Upon striking the target surface, some of the kinetic energy of the electrons is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The target surface of the anode is oriented so that the x-rays are emitted through windows defined in the evacuated enclosure and the outer housing. The emitted x-ray signal is then directed toward an x-ray subject, such as a medical patient, so as to produce an x-ray image.

In order to provide the high voltage potential that exists between the anode and the cathode, as well as to power the filament, the cathode is connected to an electrical power source via a high voltage cable. The high voltage cable is coupled to the x-ray tube via a high voltage connector. One type of connector is known as a pancake connector. Named because of its flattened, cylindrical shape, a pancake connector receives the high voltage cable through an opening disposed in the connector housing. The high voltage cable electrically connects within the connector housing to a centralized socket assembly that is configured to mate with electrical terminals disposed in a receptacle of the x-ray tube cathode. The socket assembly is electrically isolated from the connector housing by an insulating material disposed therebetween.

In greater detail, the socket assembly of the pancake connector typically comprises a metallic sleeve having an insulative potting material disposed within the interior of the sleeve. Electrical leads from the high voltage cable pass through the potting material and connect with sockets disposed on an exposed face of the socket assembly for mating with the electrical terminals of the cathode receptacle. An insulated gasket is typically disposed between the cathode receptacle and the pancake connector to further facilitate the mating of the socket assembly with the receptacle.

One particularly important application for x-ray devices such as that described above involves explosives detection by luggage inspection equipment and other related apparatus. X-ray devices are employed in explosives detection applications to examine luggage and packages in order to detect enclosed objects having a spectra that is indicative of explosive material. Such detection forms an important part of counterterrorism activities at critical locations such as airports, where personal safety and protection is paramount.

In order to accurately detect explosive material according to its spectra, the x-ray tube must be operated at relatively high operating voltages. For instance, an x-ray tube operating at 150 kV typically has a 2% false-positive rating, meaning that it erroneously detects a non-explosive for an explosive two out of every hundred scans. In contrast, the false-positive rating of a similar x-ray tube operating at 160 kV is in the range of less than one percent. Thus, higher operating voltages enable x-ray tubes to detect explosive material with more precision, resulting in quicker and more accurate scans.

Unfortunately, increasing the operating voltage of an x-ray tube also increases the incidence of voltage-related problems. One of these problems is electrical arcing. Electrical arcing represents a breakdown of the voltage potential within the tube. High voltage connectors, including pancake connectors, are especially susceptible to this undesirable side effect that is coincident with tube operation at higher power levels. For instance, electrical arcing can occur between the socket assembly, which is held at a high voltage potential, and the connector housing, which is at ground potential. Electrical arcs within the connector often emanate from locations called triple junctions, which are formed where a metallic component, an insulating component, and air meet. For instance, in one known connector design, a triple junction that is especially susceptible to arcing is formed at a point where the insulating material of the connecter housing, air, and a metallic coating applied near the socket assembly meet. In another known connector design, a triple junction is formed at a junction of the cathode receptacle, air, and the insulated gasket. These and other known pancake connector configurations have not been designed so as to adequately minimize the concentration of the electric field near triple junctions in the connector, which field concentration has been shown to increase the likelihood of a catastrophic arc during tube operation. Because it can severely damage tube components and render the x-ray device inoperable, arcing must be prevented.

The challenges described above in connection with electrical arcing across the high voltage connector are further exacerbated by the fact that known connector designs often include sharp, discontinuous features at or adjacent to the triple junctions. These sharp features, such as portions of the metallic sleeve of the socket assembly or the cathode receptacle that are near a triple junction, tend to increase the likelihood that arcing will occur. Though modifying the location and configuration of triple junctions, known pancake connector configurations have nonetheless failed to adequately reduce the likelihood for electrical arcing near such junctions during tube operation at elevated power levels.

In light of the above, a need exists to provide a high voltage connector that is designed so as to avoid the problems described above. Specifically, there is a need for a high voltage connector for use in devices, such as x-ray tubes, that provides adequate high power voltage potentials to the device without suffering electrical breakdown or increasing the likelihood of electrical arcing across the connector. Any solution should enable the x-ray tube to be operated at high power levels for use in applications such as the detection of explosive materials in packages, containers and the like.

BRIEF SUMMARY OF THE INVENTION

The present invention has been developed in response to the above and other needs in the art. Briefly summarized, embodiments of the present invention are directed to a high voltage connector for a high power device. The connector can be configured for use with an x-ray tube, for example, so as to provide the power necessary for its operation at elevated voltage potentials, which in one embodiment, can exceed 160 kV. More importantly, the high voltage connector of the present invention provides elevated voltage potentials without increasing the incidence of electrical arcing in the connector. This, in turn, preserves and protects the x-ray tube from damage that can result from such arcing.

In presently preferred embodiments, the high voltage connector comprises a pancake-style connector having an outer housing, a socket assembly, and insulating material. The connector interconnects a high voltage cable attached to a power supply with the cathode to enable tube operation. The high voltage cable is received through the outer housing and insulating material and is connected to the socket assembly, which is disposed in the housing of the connector. The socket assembly is configured so as to enable it to electrically connect to the cathode of an x-ray tube and provide its electrical requirements for proper tube operation. The insulating material is interposed between the socket assembly and the outer housing so as to electrically isolate the housing from the high voltages present in the socket assembly.

In detail, the socket assembly comprises an electrically conductive, cylindrical sleeve having an insulating potting material disposed therein. A gap is defined between a terminal end of the cylindrical sleeve and the potting material to define an annular gap. A receptacle portion of the cathode is received in the gap. A metal contact is disposed in an annular notch defined in the surface of the sleeve near the terminal end. The metal contact electrically connects the sleeve with the cathode receptacle. Additionally, female sockets are provided in the terminal end of the potting material of the connector to receive and electrically connect with corresponding electrical contacts of the cathode receptacle. These electrical connections between the socket assembly and the cathode provide the necessary electrical supply required by the cathode during tube operation.

The terminal end of the cylindrical sleeve is shaped so as to reduce the likelihood of electrical arcing within the connector. In one presently preferred embodiment, the terminal end of the sleeve is rounded during manufacture to have a semi-circular cross section. The insulating material of the connector is disposed in the housing in partial contact with the rounded terminal end of the sleeve. A triple junction is formed at the meeting point of the terminal end of the sleeve, the insulating material of the connector, and the air existing in the gap defined between the sleeve and the potting material of the socket assembly. Because of the rounded terminal end of the cylindrical sleeve, however, the triple junction does not create a preferred source point for arcing to occur. The rounded shape of the sleeve's terminal end serves both to reduce the electric field strength present at the surface of the conductive sleeve, and to force the electric field away from the triple junction. These two effects cooperate to prevent arcing from originating at the triple junction. Additionally, the lack of discontinuous or sharp features at the triple junction further reduces the likelihood for arcing.

In other embodiments of the present invention, the terminal end of the cylindrical socket assembly sleeve can be shaped to define other continuous, cross sectional shapes, including parabolic or elliptical curves.

Implementation of the above teachings enables the manufacture and use of high voltage connectors in high power x-ray tubes that are able to operate at high voltages, in some cases exceeding 150 kV. This allows such tubes to be utilized in a variety high power applications, including explosives detection, where the higher voltage enables more accurate x-ray scans to be produced. Further, the high voltage connector of the present invention enables high voltage tube operation without increasing the likelihood for electrical arcing in the connector.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is understood that the drawings are diagrammatic and schematic representations of presently preferred embodiments of the invention, and are not limiting of the present invention nor are they necessarily drawn to scale.

FIGS. 1–6 depict various features of embodiments of the present invention, which is generally directed to a high voltage connector having favorable electrical properties for avoiding electrical arcing within the connector. The high voltage connector is utilized in connection with a high power device, such as an x-ray tube, though other high power devices can also benefit from the connector as taught herein. The present connector, enables an x-ray tube to operate at relatively higher operating voltages while controlling the incidence of electrical arcing within the connector. This, in turn, provides stability to the x-ray tube while operating at elevated voltages, allowing it to be utilized in a variety of high power applications, including explosives detection.

Figure 1:
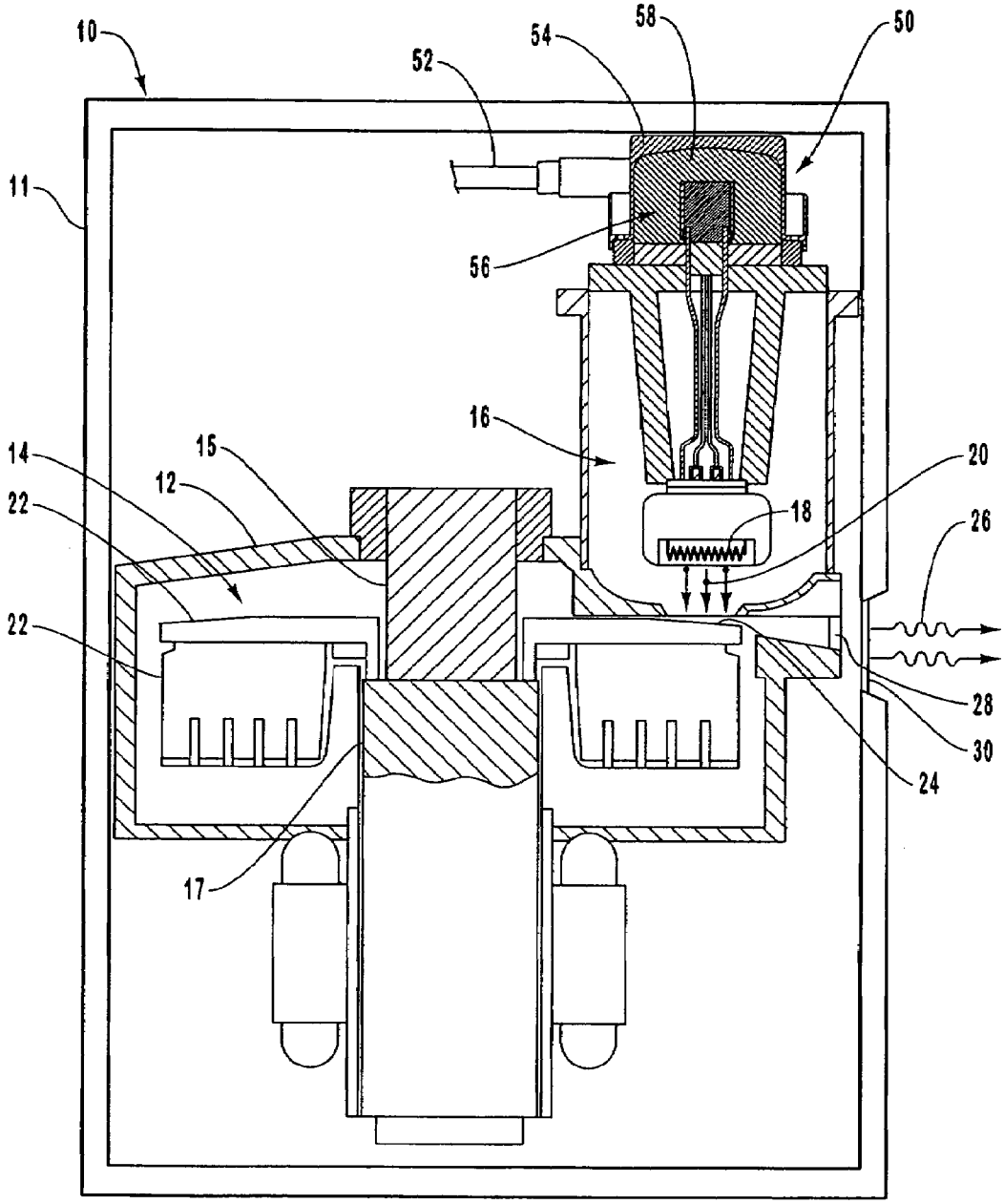
FIG. 1 is a cross sectional view of an x-ray device utilizing one embodiment of the present invention.

Reference is first made to FIG. 1, which illustrates in cross section a simplified structure of a rotating anode-type x-ray tube, designated generally at 10. As mentioned, the present invention is implemented in a pancake-style high voltage connector employed in connection with an x-ray tube, such as that depicted at 10 in FIG. 1. However, it is appreciated that the teachings herein can also be applied to high voltage connectors utilized with other devices as well.

The x-ray tube 10 includes an outer housing 11, within which is disposed an evacuated enclosure 12. Disposed within the evacuated enclosure 12 are a rotating anode 14 and a cathode 16. The anode 14 is spaced apart from and oppositely disposed to the cathode 16, and is at least partially composed of a thermally conductive material such as tungsten or a molybdenum alloy. The anode 14 is rotatably supported by a rotor shaft 15 and a bearing assembly 17.

As is typical, a high voltage potential is provided between the anode 14 and cathode 16. In the illustrated embodiment, the cathode 16 is biased by a power source (not shown) to have a large negative voltage, while the anode 14 is maintained at ground potential. In other embodiments, the cathode is biased with a negative voltage while the anode is biased with a positive voltage. X-ray tubes featuring either of these biasing configurations can utilize the present high voltage connector. Also, while the x-ray tube 10 illustrated in FIG. 1 features a rotating anode, it is appreciated that stationary anode x-ray tubes can also benefit from the high voltage connector to be described herein.

The cathode 16 includes at least one filament 18 that is connected to an appropriate power source (not shown). During operation, an electrical current is passed through the filament 18 to cause electrons, designated at 20, to be emitted from the cathode 16 by thermionic emission. Application of the high voltage differential between the anode 14 and the cathode 16 then causes the electrons 20 to accelerate from the cathode filament 18 toward a focal track 22 that is positioned on a target surface 24 of the rotating anode 14. The focal track 22 is typically composed of tungsten or a similar material having a high atomic ("high Z") number. As the electrons 20 accelerate, they gain a substantial amount of kinetic energy, and upon striking the target material on the focal track 22, some of this kinetic energy is converted into electromagnetic waves of very high frequency, i.e., x-rays. The emitted x-rays, designated at 26, are directed through x-ray transmissive windows 28 and 30 disposed in the evacuated enclosure 12 and outer housing 11, respectively. The windows 28 and 30 are comprised of an x-ray transmissive material so as to enable the x-rays to pass through the windows and exit the tube 10. The x-rays exiting the tube can then be directed for penetration into an object, such as a patient's body during a medical evaluation, or a sample for purposes of materials analysis.

In accordance with one presently preferred embodiment, the x-ray tube 10 further includes a high voltage connector assembly, designated at 50, which is operably connected to the cathode 16, as seen in FIG. 1. The high voltage connector 50 is responsible for electrically coupling a high voltage cable 52 to the x-ray tube 10. The high voltage cable 52 is, in turn, connected to a high voltage power source (not shown). The high voltage connector 50, via the high voltage cable 52, facilitates the provision of an electrical voltage bias to the cathode 16, as well as an electric current: to the filament 18 during tube operation. As such, the connector 50 couples electrical components of the cathode 16 with the high voltage cable 52, as explained more fully below.

Figure 2:
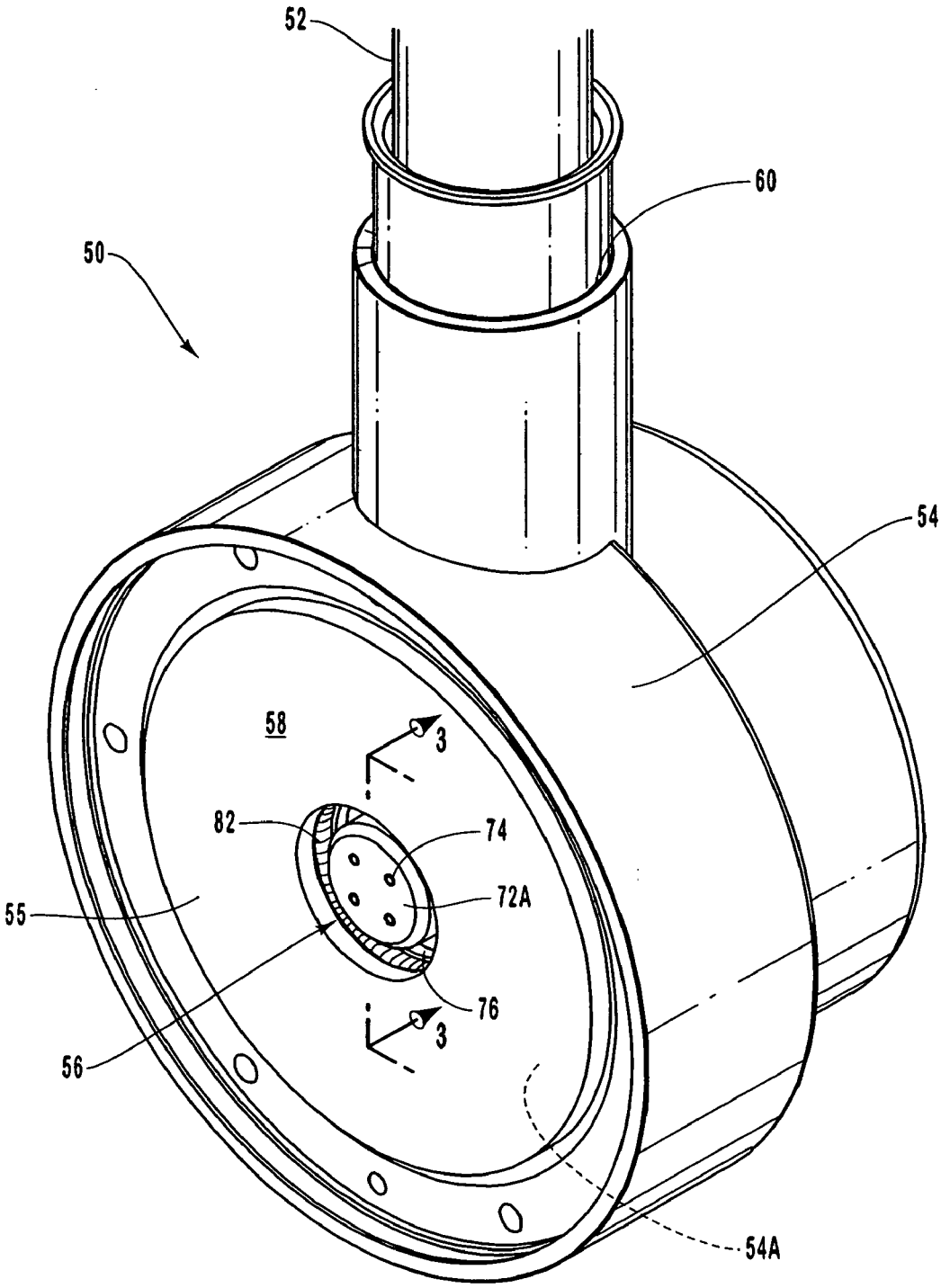
FIG. 2 is a perspective view of one embodiment of the present high voltage connector.

Reference is now made to FIG. 2, which shows a perspective view of the high voltage connector 50. The high voltage-connector 50 generally comprises an outer connector housing 54, a socket assembly 56, and insulating material 58. The connector housing 54, in addition to housing the other components of the connector 50, provides a mounting surface for attaching the connector to a portion of the cathode 16 via mechanical fasteners or other appropriate mode of attachment. The housing 54 further defines a port 60 through which the high voltage cable 52 passes. The high voltage cable 52 electrically connects with the socket assembly 56 within the housing 54 as described below. As seen in the figure, the socket assembly 56 is disposed within a cavity 54A defined by the housing 54, and is centrally positioned on a bottom face 55 of the connector 50 so as facilitate electrical connection with corresponding components of the cathode 16. The insulating material 58 substantially fills the rest of the cavity 54A to provide electrical isolation of the housing 54 from the socket assembly 56. The insulating material 58, in one embodiment, comprises an insulating epoxy.

Figure 3:
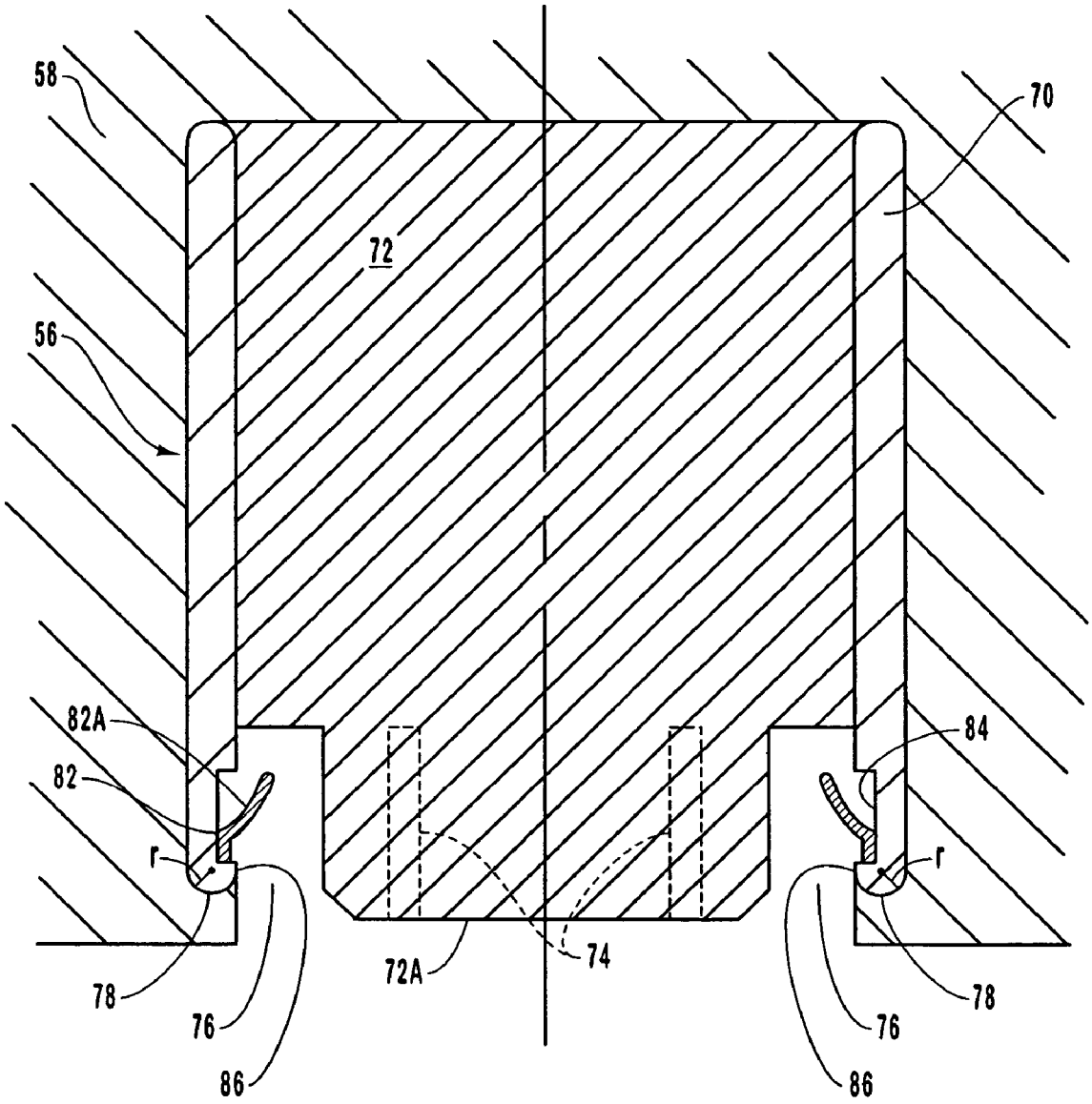
FIG. 3 is a cross sectional view of the high voltage connector of FIG. 2, illustrating various components thereof.
Figure 4:
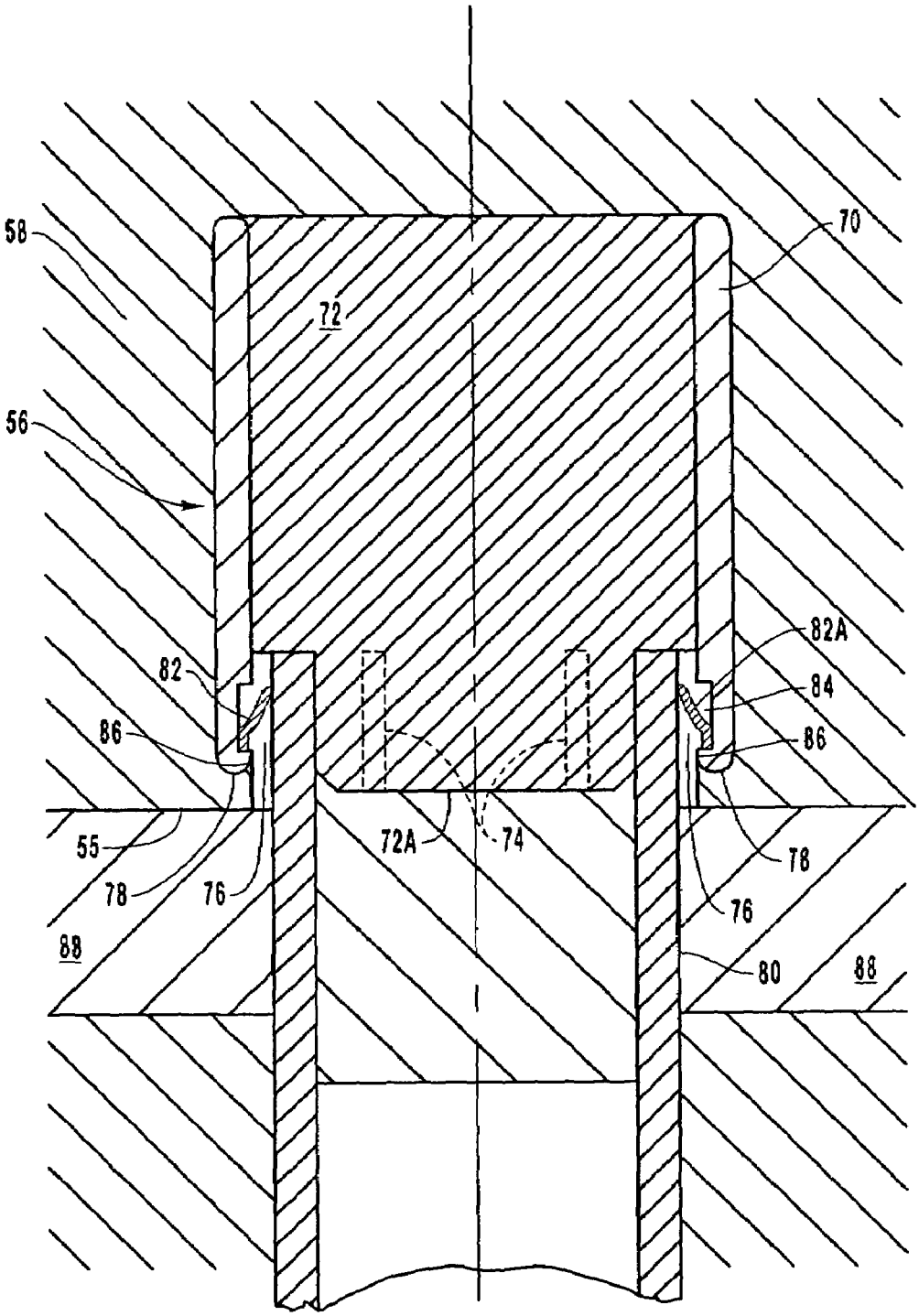
FIG. 4 is a cross sectional view of the high voltage connector of FIG. 2, illustrating its connection to the cathode assembly of an x-ray device.

Reference is now made to FIGS. 3 and 4, which cross-sectionally show the socket assembly 56 of FIG. 2 in greater detail. The socket assembly 56 generally comprises a cylindrical, electrically conductive sleeve 70, and a potting material 72 disposed within the sleeve. As explained more fully below, the cylindrical sleeve 70 is configured to electrically connect with a portion of a cathode receptacle 80 to provide the cathode 16 with a proper voltage bias. As such, the sleeve preferably comprises a metal, such as brass. As will be seen, the sleeve 70 includes an annular terminal end 78 that is configured to prevent electrical arcing, in accordance with the present invention.

The potting material 72 comprises, in one embodiment, an insulating material, such as plastic epoxy or other appropriate material. A plurality of female sockets 74 are disposed on the bottom face 55 of the connector 50 at a terminal end 72A of the potting material 72. Each socket 74 is electrically connected to the high voltage cable 52 (see FIGS. 1 and 2), and is configured to electrically connect with corresponding terminals (not shown) disposed in the cathode 16 when the connector 50 is operably attached to the x-ray tube 10. This interconnection provides an electric current to the one or more filaments 18 disposed in the cathode 16, thereby enabling the filaments to produce electrons by thermionic emission. The sockets 74 are electrically isolated from the sleeve by the potting material 72. In the present embodiment, four sockets 74 are disposed at the terminal end 72A, however, more or fewer sockets can be disposed therein. Also, though shown in FIG. 3 to comprise female receptacles, in other embodiments the sockets 74 could alternatively comprise male electrical terminals or some other electrical connection configuration.

A cylindrically shaped, annular gap 76 is defined between the sleeve 70 and the potting material 72 at the terminal ends 72A and 78 of the potting material 72 and the sleeve 70, respectively. The gap 76 is configured to receive therein a portion of the cathode receptacle 80 and provide a voltage bias to the cathode 16 during tube operation.

In accordance with the above, the socket assembly 56 further comprises means for electrically connecting the sleeve 70 to the cathode receptacle 80. By way of example, this function is provided by structure comprising a conductive contact interposed between the sleeve 70 and the cathode receptacle 80. In presently preferred embodiments, the conductive contact comprises a metal fingerstock ring 82 having a plurality of electrically conductive, resilient extensions 82A. The fingerstock ring 82 is disposed in an annular notch 84 defined on an inner surface of the sleeve 70 near the terminal end 78 of the sleeve. The fingerstock ring 82 is configured to physically and electrically connect the sleeve 70 to the cathode receptacle 80 via the plurality of resilient extensions 82A when the high voltage connector 50 is attached to the: cathode 16, as described further below. This enables the cathode receptacle 80 to be electrically charged for proper cathode operation.

As can be seen in FIGS. 3 and 4, the terminal end 78 of the sleeve 70 is substantially enveloped by the insulating material 58 of the connector 50. A triple junction 86 is formed at the junction of the sleeve 70, the insulating material 58, and air present in the gap 76. The terminal end 78 of the sleeve 70 is further configured to advantageously prevent electrical arcing at the triple junction 86. In accordance with this, the terminal end 78 of the cylindrical sleeve 70 is shaped to define a smooth, continuous surface. In the illustrated embodiment, the terminal sleeve end 78 defines an outwardly extending, rounded cross sectional shape having a radius "r." The utility of the smoothly continuous shape of the terminal sleeve end 78 in reducing electrical arcing at or near the triple junction 86 is explained further below in connection with FIG. 5. As will be discussed, in other embodiments the terminal end 78 of the sleeve 70 can comprise other continuous cross sectional shapes as well.

Continuing reference is made to FIG. 4, which illustrates the interconnection of the present connector 50 with the cathode 16. As suggested, the cathode receptacle 80 is received by the connector 50 into the gap 76 defined in the socket assembly 56. Electrical connection between the cathode receptacle 80 and the cylindrical sleeve 70 of the socket assembly 56 is established via the fingerstock ring 82 disposed in the notch 84. The, insertion of the cathode receptacle 80 into the gap 76 causes the resilient extensions 82A of the fingerstock ring 82 to deform and engage the surface of the receptacle. This ensures a secure physical and electrical connection between the cathode receptacle 80 and the socket assembly sleeve 70. It is appreciated that the shape, size, and particular configuration of the gap 76, the fingerstock ring 82, and the cathode receptacle 80, as well as their interconnection, can vary from what is shown in FIG. 4.

FIG. 4 further illustrates an insulating gasket 88 that can be interposed between the cathode 16 and the connector 50 when the two are attached. Specifically, the insulating gasket 88 is annular and fits about a portion of the cathode receptacle 80 to further insulate the high voltage portions of the socket assembly 56 and cathode receptacle 80 from other portions of the x-ray tube 10.

Figure 5:
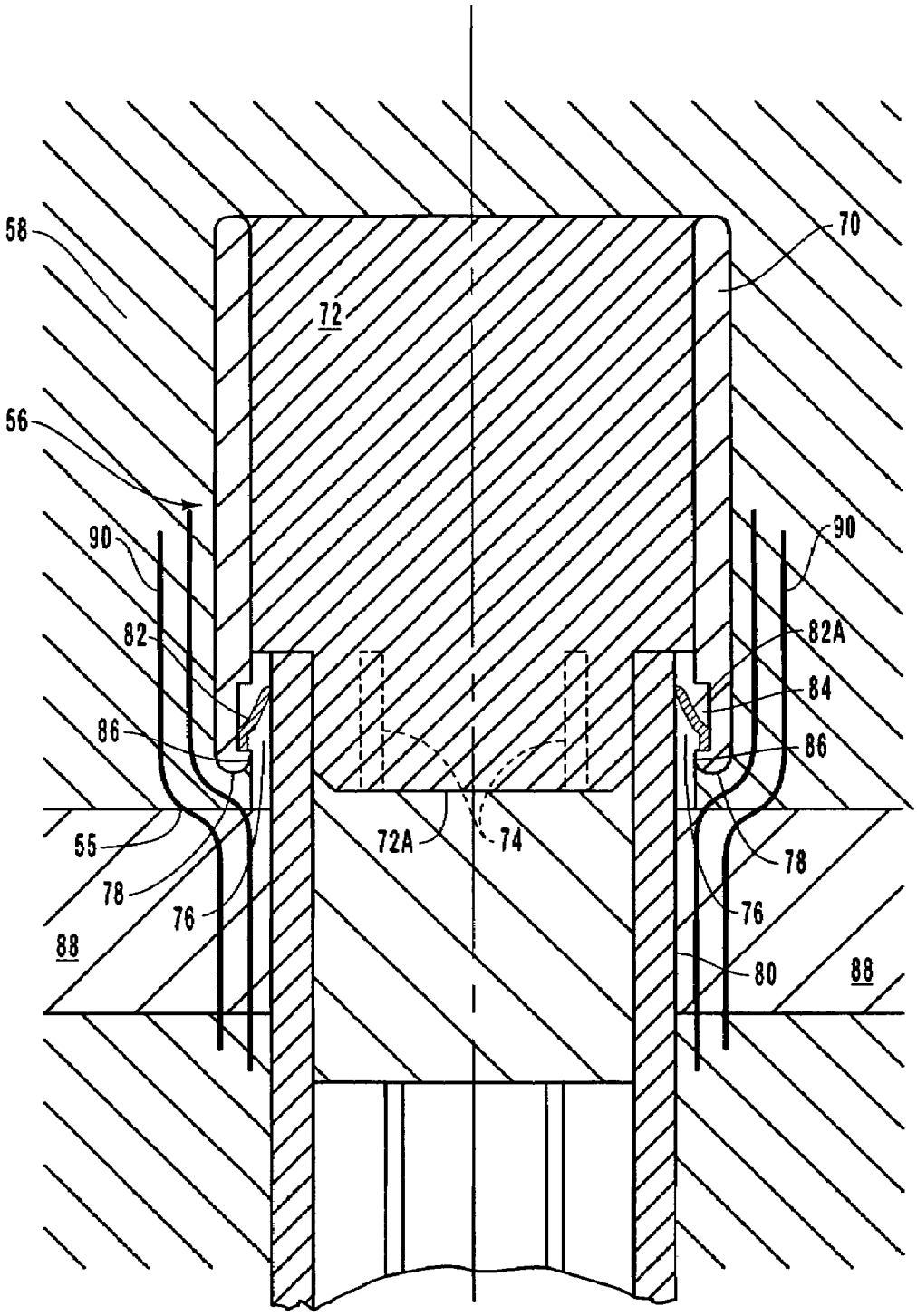
FIG. 5 is a cross sectional view of the high voltage connector of FIG. 4, illustrating electric fields associated with operation of the connector.

Reference is now made to FIG. 5, which illustrates the connection of the high voltage connector 50 to the cathode 16, as shown in FIG. 4, with additional details. As already discussed, the socket assembly 56 of the connector 50 is responsible for providing a negative voltage bias for the cathode 16 as well as providing an electrical signal for operation of one or more filaments 18. As such, the socket assembly 56 is maintained at a high voltage during operation of the x-ray tube 10. The high voltage that is present in and around the socket assembly 56 during tube operation is represented in FIG. 5 by electric field lines 90.

As mentioned earlier, the continuously shaped terminal end 78 of the conductive socket assembly sleeve 70 assists in preventing electrical arcing at or near the triple junction 86 formed at the meeting point of the terminal end of the conductive sleeve, the insulating material 58, and air present in the gap 76. The continuous surface defined by the terminal end 78 of the sleeve 70 reduces arcing in at least two ways. First, and as can be seen in FIG. 5, the terminal end 78, by virtue of its rounded shape, pushes the electric field away from the triple junction 86. Second, as a consequence of the field being pushed away by the terminal end 78, the electric field strength existing at the conductive surface of the sleeve 70 near the continuously shaped terminal end 78 is reduced. Thus, less field strength exists at the triple junction 86, which is adjacent the terminal end 78. The combination of these two factors results in a relatively reduced field strength existing at the triple junction 86. As electrical arcs are often created at triple junctions such as that shown at 86, the reduction of the electric field in this region per the present invention reduces the overall incidence of electrical arcing within the present high voltage connector 50, particularly around the socket assembly 56.

It is also seen in FIG. 5 that, because of the continuous shape of the terminal end 78 of the sleeve 70, no sharp edges exist at the triple junction 86. This further enhances the capability of the socket assembly 56 to subdue the tendency for electrical arcing to occur at the triple junction 86.

As a result of the reduced electrical arcing risk made possible by the present invention, the high voltage connector 50 can be used to maintain tube voltages at a higher level than what has been previously possible with known connectors. In one example, a high voltage connector of the present invention was able to maintain an operating x-ray tube voltage level of approximately 190 kV, significantly more than the typical 150 kV voltage limit. In another example, an x-ray tube utilizing a high voltage connector of the present invention was continuously run at an operating voltage level of 160 kV for several weeks without electrical arcing. Thus, it is seen that the high voltage connector of the present invention enables x-ray tubes to significantly expand the voltage levels at which they can operate.

As already mentioned, the higher voltage levels obtained by the present invention allow for x-ray tubes to be utilized in specialized applications, such as explosives detection, where higher voltages are critical to ensuring adequate detection. For example, in explosive detection, an x-ray tube operating at a voltage of 160 kV is able to detect explosives in luggage and other objects with a false-positive rate of less than one percent. In contrast, a lower powered x-ray tube operating at only 150 kV can have a false-positive rate of 2% or more.

Figure 6:
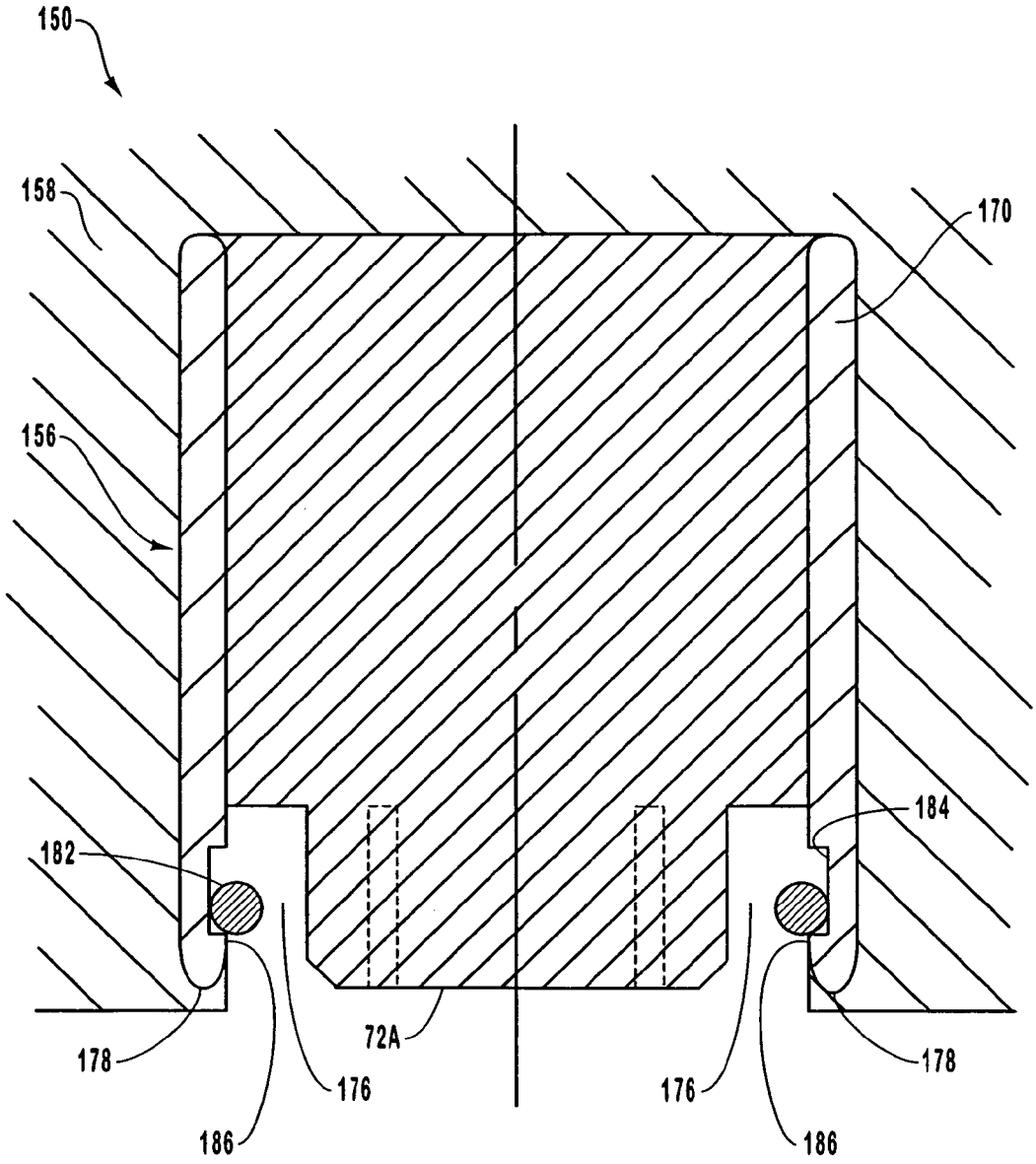
FIG. 6 is a cross sectional view illustrating various features of another embodiment of the present high voltage connector.

Reference is now made to FIG. 6, which depicts various features of an alternative embodiment of the present high voltage connector. As illustrated, a high voltage connector 150 includes a socket assembly 156 disposed therein. The socket assembly 150 includes a cylindrical sleeve 170 having an annular terminal end 178. The terminal end 178 defines a continuously shaped surface. The cross sectional shape of the terminal end 178 is parabolic in the present embodiment and meets with insulating material 158 and air disposed in a gap 176 to form a triple junction 186. The continuous cross sectional shape of the terminal end 178 of the sleeve 170 prevents electrical arcing at the triple junction 186 during tube operation in the same manner as in the previous embodiment, that is, it operates to distance the electric field from the triple junction 186 to reduce the field strength along the conductive surface of the sleeve 170 near the terminal end 178. Additionally, the triple junction 186 is characterized by the absence of sharp edges, which would otherwise increase the likelihood for arcing.

As shown in FIGS. 3 and 6, the terminal end of the sleeve in the embodiments described herein can be varied in cross sectional shape while still performing its intended function. Indeed, the cross sectional shape of the terminal end of the sleeve can define a circular, parabolic, elliptical, or other continuous surface. Preferably, the shape defined by the terminal end of the sleeve is characterized by: a smooth and continuous surface having no, sharp edges. Further, the surface should be defined such that it causes the electric field to be reduced in strength at any triple junction that is formed in part by the terminal end. Thus, terminal end shapes other than those described or illustrated herein are also appreciated as falling within the present invention.

The socket assembly 156 shown in FIG. 6 further includes another example of a means for electrically connecting the sleeve 170 to a cathode receptacle (not shown). In the illustrated embodiment, this function is provided by structure comprising an electrically conductive O-ring interposed between the sleeve 170 and the cathode receptacle. The O-ring 182 can be disposed in an annular notch 184 defined on an inner surface of the sleeve 170, though other configurations are also possible. Upon insertion of the cathode receptacle (not shown) into the gap 176 of the socket assembly 156, the O-ring 182 establishes both physical and electrical contact between the sleeve 170 and the receptacle. As before, this enables electrical conductivity to the cathode of the x-ray tube to be established. The O-ring 182 can be comprised of one or more of a variety of conductive materials, including metal.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A high voltage connector suitable for use in connecting a high voltage cable to a x-ray generating device, the high voltage connector comprising:

an outer housing having a port capable of receiving the cable;

an insulating material disposed within at least a portion of the outer housing;

a socket portion disposed within the outer housing, the socket portion comprising:

a sleeve comprising an electrically conductive material, the sleeve having a terminal end portion; and a potting material disposed within the sleeve, the potting material and sleeve together defining a gap such that an electrically conductive portion of the x-ray generating device is received in the gap.

2. A high voltage connector as defined in claim 1, wherein the gap is substantially cylindrical in shape.

3. A high voltage connector as defined in claim 1, wherein the sleeve comprises brass.

4. A high voltage connector as defined in claim 1, wherein the insulating material substantially envelops a portion of the terminal end of the sleeve, wherein the junction between the insulating material and the sleeve is substantially smooth and continuous.

5. A high voltage connector as defined in claim 1, wherein the insulating material comprises epoxy.

6. A high voltage connector as defined in claim 1, further comprising a metal contact electrically connecting the electrically conductive portion of the x-ray generating device with the sleeve.

7. A high voltage connector as defined in claim 6, wherein the metal contact is disposed in a notch, the notch being defined in a surface of the sleeve.

8. A high voltage connector as defined in claim 7, wherein the notch is defined at a point that is adjacent to the terminal end of sleeve.

9. A high voltage connector as defined in claim 1, wherein the terminal end portion defines a substantially continuous cross sectional shape.

10. A high voltage connector as defined in claim 9, wherein the continuous cross sectional shape of the terminal end of the sleeve is selected from the group consisting of round, parabolic, and elliptical.

11. A high voltage connector operable to electrically connect a high voltage cable to an x-ray device, the x-ray device including an electron-producing cathode and an anode positioned to receive the electrons emitted by the cathode, the high voltage connector comprising:

an outer housing;

an insulating material disposed within the outer housing; and a socket assembly substantially surrounded by the insulating material, the socket assembly comprising;

a sleeve comprising an electrically conductive material, the sleeve having a circular terminal end portion;

an electrically insulating potting material disposed within the sleeve, the potting material and sleeve together defining a gap such that an electrically conductive portion of the cathode is received in the gap; and a metal contact electrically connecting the sleeve with the electrically conductive portion of the cathode received in the gap, the metal contact being disposed in a notch defined in the sleeve.

12. A high voltage connector as defined in claim 11, wherein the terminal end portion defines a continuously rounded surface.

13. A high voltage connector as defined in claim 11, wherein the socket assembly further comprises electrical sockets disposed in the socket assembly, the sockets electrically mating with electrical terminals disposed in the cathode.

14. A high voltage connector as defined in claim 11, wherein the metal contact physically contacts both the conductive portion of the cathode received in the gap and the sleeve.

15. A high voltage connector as defined in claim 11, wherein the metal contact comprises a metallic O-ring.

16. A high voltage connector as defined in claim 11, wherein the metal contact comprises an annular ring of fingerstock material.

17. A high voltage connector as defined in claim 11, wherein the notch is defined on an inner surface of the sleeve.

18. A high voltage connector as defined in claim 11, wherein the sleeve is substantially cylindrical.

19. A high voltage connector as defined in claim 11, wherein a triple junction is formed at a point where the insulating material, the terminal end of the sleeve, and air disposed in the gap meet.

20. A high voltage connector as defined in claim 19, wherein the terminal end of the sleeve is operable to reduce the strength of an electric field near the triple junction, the electric field being produced during operation of the x-ray device.

* * * * *

UNITED STATES PATENT AND TRADEMARK OFFICE

CERTIFICATE OF CORRECTION

PATENT NO. : 7,033,192 B2
APPLICATION NO. : 10/982566
DATED : April 25, 2006
INVENTOR(S) : Hansen It is certified that error appears in the above-identified patent and that said Letters Patent is hereby corrected as shown below:

Column 4
Line 28, after "variety" insert --of--

Column 7
Line 29, after "attached to the" remove [:]

Column 8
Line 20, after "terminal end" insert --78--
Line 21, after "conductive sleeve" insert --70--

Column 9
Line 26, after "is characterized by" remove [:]
Line 36, after "is provided by" insert --a--

Signed and Sealed this

Third Day of August, 2010

David J. Kappos

David J. Kappos
*Director of the United States Patent and Trademark Office*